US008405294B2

(12) United States Patent
Matsumoto et al.

(10) Patent No.: US 8,405,294 B2
(45) Date of Patent: Mar. 26, 2013

(54) FIELD EMISSION ELECTRON SOURCE

(75) Inventors: Takahiro Matsumoto, Tokyo (JP); Yoichiro Neo, Shizuoka (JP)

(73) Assignee: Stanley Electric Co., Ltd., Tokyo (JP)

( * ) Notice: Subject to any disclaimer, the term of this patent is extended or adjusted under 35 U.S.C. 154(b) by 574 days.

(21) Appl. No.: 12/343,396

(22) Filed: Dec. 23, 2008

(65) Prior Publication Data

US 2010/0033072 A1 Feb. 11, 2010

(30) Foreign Application Priority Data

Dec. 26, 2007 (JP) ..... 2007-335190

(51) Int. Cl.
*H01J 1/00* (2006.01)
*H01J 19/06* (2006.01)

(52) U.S. Cl. ..... 313/311; 313/495; 313/346 R

(58) Field of Classification Search ..... 313/495–497, 313/309–311, 346 R, 346 DC; 252/500, 252/501.1, 506, 507, 510, 511
See application file for complete search history.

(56) References Cited

U.S. PATENT DOCUMENTS

2001/0035499 A1* 11/2001 Marsh ..... 250/423 F
2003/0106998 A1* 6/2003 Colbert et al. ..... 250/306
2003/0127960 A1* 7/2003 Jeong et al. ..... 313/309
2004/0036403 A1* 2/2004 Ono et al. ..... 313/311
2005/0067936 A1* 3/2005 Lee et al. ..... 313/309
2005/0168122 A1* 8/2005 Dahl et al. ..... 313/311
2005/0212395 A1* 9/2005 Anazawa et al. ..... 313/311
2005/0275331 A1* 12/2005 Takai et al. ..... 313/311
2007/0035227 A1* 2/2007 Haba et al. ..... 313/309
2008/0174229 A1* 7/2008 Jeong ..... 313/495

FOREIGN PATENT DOCUMENTS

JP H11-297189 A 10/1999
JP 2000-208029 A 7/2000

OTHER PUBLICATIONS

Tien T. Tsong, "Atom-Probe Field Microscopy", 1990, pp. 110-115, Cambridge University Press.

Iwatsu, et al., "An Attempt to Image Organic Molecules with FIM", Journal de Physique, Nov. 1987, Colloque pp. C6-263-268 Mentioned on p. 3 of the as-filed translation of the specification as concise explanation of relevance.

* cited by examiner

*Primary Examiner* — Joseph L Williams
*Assistant Examiner* — Kevin Quarterman
(74) *Attorney, Agent, or Firm* — Chen Yoshimura LLP

(57) ABSTRACT

A field emission electron source for emitting electrons under applied electric field includes a cold cathode having molecules of an aromatic compound vapor-deposited thereon at a pointed end of said cold cathode.

5 Claims, 4 Drawing Sheets

FIELD EMISSION ELECTRON SOURCE

BACKGROUND OF THE INVENTION

1. Field of the Invention

The present invention relates to field emission electron sources which emit electrons under applied electric field.

2. Description of Related Art

In the conventional art, field emission electron sources, which emit electrons under applied electric field, have been known and used in devices such as scanning electron microscopes, the electron beam lithography, and X-ray diffractometers. The emitted electron current (emission current) J from a cold cathode of the above-mentioned field emission electron source is expressed by the following equation (1):

$$J=A\cdot(F^2/\phi)exp(-B\Phi^{3/2}/F) \quad (1)$$

where F is the electric field strength, $\phi$ is the work function, and A, B are constants.

According to the equation (1), it is clear that a larger emission current J can be obtained by having a smaller work function $\phi$.

As a field emission electron source, a cold cathode made of tungsten covered by a thin metal film has been known (See, e.g., Patent Document 1 below). With the field emission electron source, a large emission current J can be obtained by having a tungsten single crystal covered with thin film coatings of pure gold and pure aluminum on the side plane of the (310) plane, and with a thin film coating of a tungsten-gold-aluminum ternary alloy at the pointed end of said (310) plane, which provide a lower work function $\phi$ than the tungsten work function ($\phi$=5.5 eV).

In order to obtain an even larger emission current J, one may consider coating the cold cathode with a material whose work function $\phi$ is lower than that of the tungsten, such as the barium oxide and carbon etc. The work function of barium oxide is 2.0 eV and the work function of carbon is 4.5 eV.

A carbon nanotube can be listed as a candidate for such carbon. However, in such a field emission electron source having the cold cathode coated with the carbon nanotube, because of the large gas adsorption of the carbon nanotube, a problem exists that it is difficult to obtain a stable field emission due to significant and continuous degassing from the carbon nanotube under the vacuum operation.

In addition, there arises a problem in using the field emission electron source with coatings of the barium oxide or the carbon, where destruction of the field emission electron source occurs easily due to the induced discharge at the interface part of the coatings under a low electric field which is caused by a weakened interface.

Furthermore, there exists another problem in that it is difficult to obtain a large emission current J because the emission current is saturated at a low current level due to the occurrence of the contact resistance between the metal cold cathode and the thin film coating made of barium oxide or the carbon, etc.

Patent Document 1: Japanese Laid-Open Patent Application Publication No. H 11-297189.

Patent Document 2: Japanese Laid-Open Patent Application Publication No. 2000-208029.

Non-Patent Document 1: Tien T. TSONG, ATOM-PROBE FIELD MICROSCOPY and Cambridge University press, 1990, p. 110-115.

Non-Patent Document 2: F. Iwatsu and H. Morikawa and T. Tera, Journal de Physique (1987) Colloque C6-263, "An Attempt to Image Organic Molecules with FIM."

SUMMARY OF THE INVENTION

Accordingly, the present invention is directed to a field emission electron source that substantially obviates one or more of the problems due to limitations and disadvantages of the related art.

An object of the present invention is to provide an improved field emission electron source capable of generating a large emission current with a low applied voltage.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present invention provides a field emission electron source for emitting electrons under applied electric field, including a cold cathode having molecules of an aromatic compound vapor-deposited thereon at a pointed end of said cold cathode.

In another aspect, the present invention provides a method for making a field emission electron source, including preparing a cold cathode having a pointed end; and vapor-depositing an aromatic compound on the pointed end of the cold cathode.

An embodiment of the present invention has a feature in which molecules of an aromatic compound are vapor deposited at the pointed end of the cold cathode of the emission electron source which emits electrons under applied electric field.

According to this aspect of the present invention, under an applied electric field, a large number of electrons are emitted from the molecules of the aforementioned aromatic compound which are vapor deposited at the pointed end of the cold cathode. As a result, a large emission current can be obtained even when the applied electric field is small.

Here, the molecule of the aforementioned aromatic compound forms a flat structure due to the fact that atoms of conjugate unsaturated ring make the $sp^2$ bonding with neighboring other atoms, and the molecule carries $\pi$ electron clouds caused by non-localized $\pi$ electrons on both sides of the flat structured molecule. The aromatic compound may only have carbon as the constituent atoms for the conjugate unsaturated ring. Benzene can be mentioned as an example of such a chemical compound.

In addition to carbon, nitrogen, phosphorus, sulphur, and oxygen can be the constituent atoms for the conjugate unsaturated ring. Flavanthrone can be an example of such a chemical compound. Further, the aromatic compound can be a fused ring of multiple conjugate unsaturated rings, such as coronene and pentacene, for example. Furthermore, the aromatic compound can be one which forms a complex with a metal. Phthalocyanine and tris-(8-hydroxyquinoline) aluminum are examples of such a chemical compound.

The individual molecule of the above-mentioned aromatic compound having a flat structure is considered to be vapor deposited such that it stands upright with respect to the pointed end of the cold cathode of the field emission electron source. As a result, when the electric field is applied, it is considered that the electric field is concentrated at the end point of the flat structured molecule, and the aforementioned $\pi$ electrons are extracted by the concentrated electric field, thereby yielding a large emission current.

In one aspect of the present invention, the material of the aforementioned cold cathode can be formed of one of tungsten, titanium, tantalum, and lanthanum hexaboride.

In another aspect, the present invention provides a method for emitting electrons from a field emission electron source, including applying an electric filed to a cold cathode that has molecules of an aromatic compound vapor-deposited thereon at a pointed end of said cold cathode; and setting a temperature of the cold cathode to an elevated temperature to suppress an absorption of residual molecules of the aromatic compound into the field emission electron source, the elevated temperature being lower than a temperature at which the vapor-deposited molecules of the aromatic compound significantly evaporate.

It is to be understood that both the foregoing general description and the following detailed description are exemplary and explanatory, and are intended to provide further explanation of the invention as claimed.

DETAILED DESCRIPTION OF THE PREFERRED EMBODIMENTS

Figure 1:
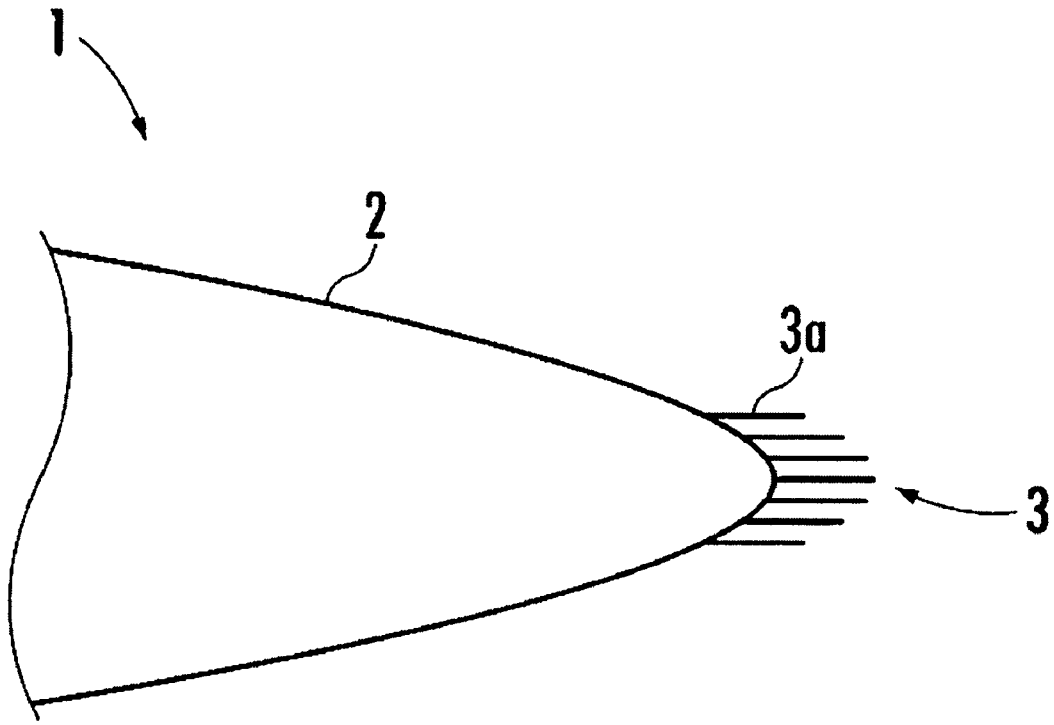
FIG. 1 is a schematic diagram of a field emission electron source according to an embodiment of the present example.
Figure 2:
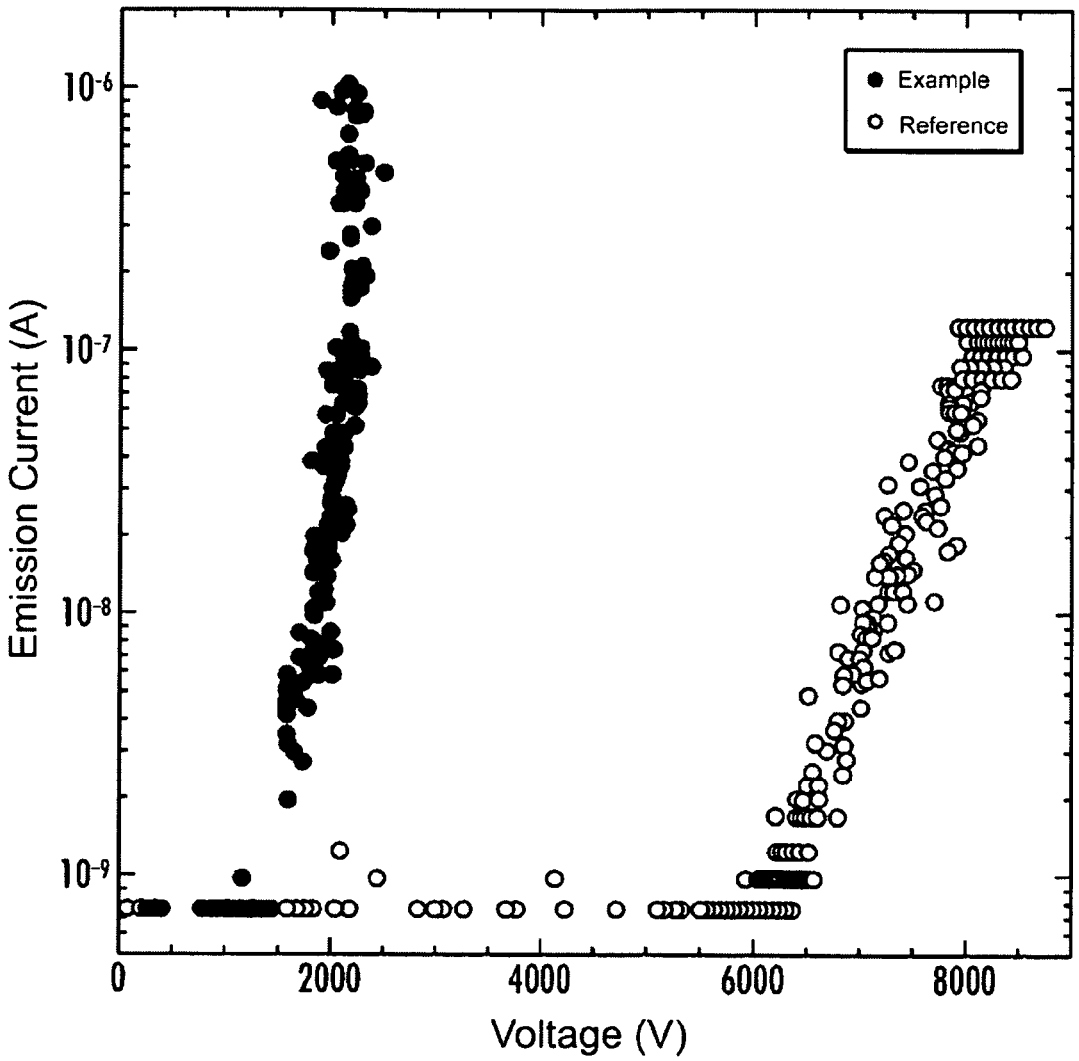
FIG. 2 is a graph showing the emission current of a field emission electron source according to an embodiment of the present invention.
Figure 3:
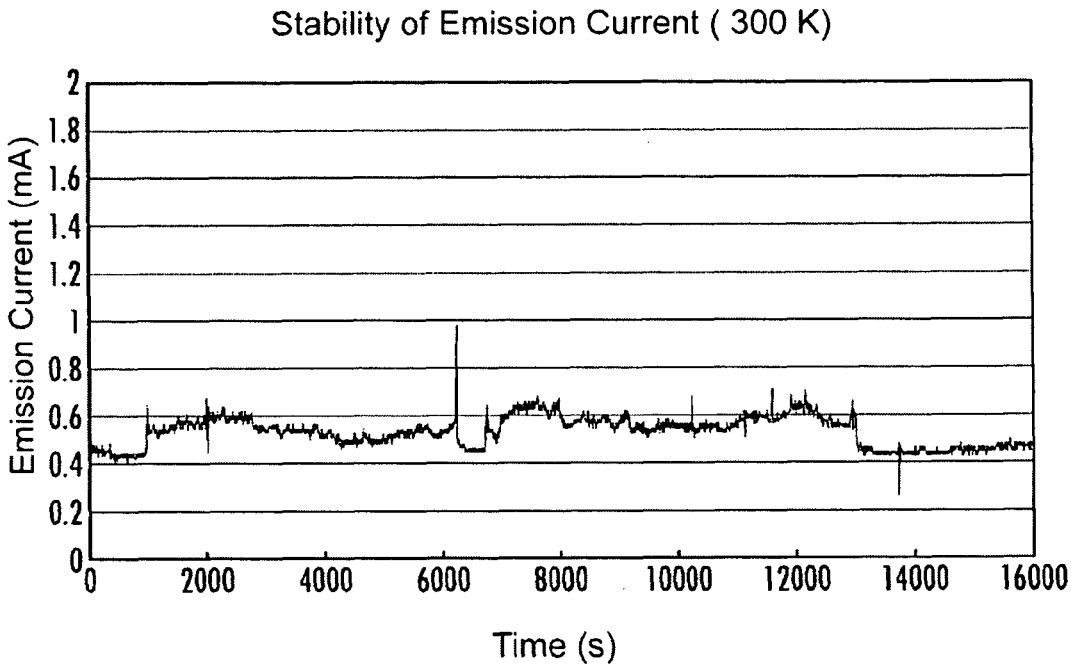
FIG. 3 is a graph showing the fluctuation and the stability of the emission current of a field emission electron source according to an embodiment of the present invention.
Figure 4:
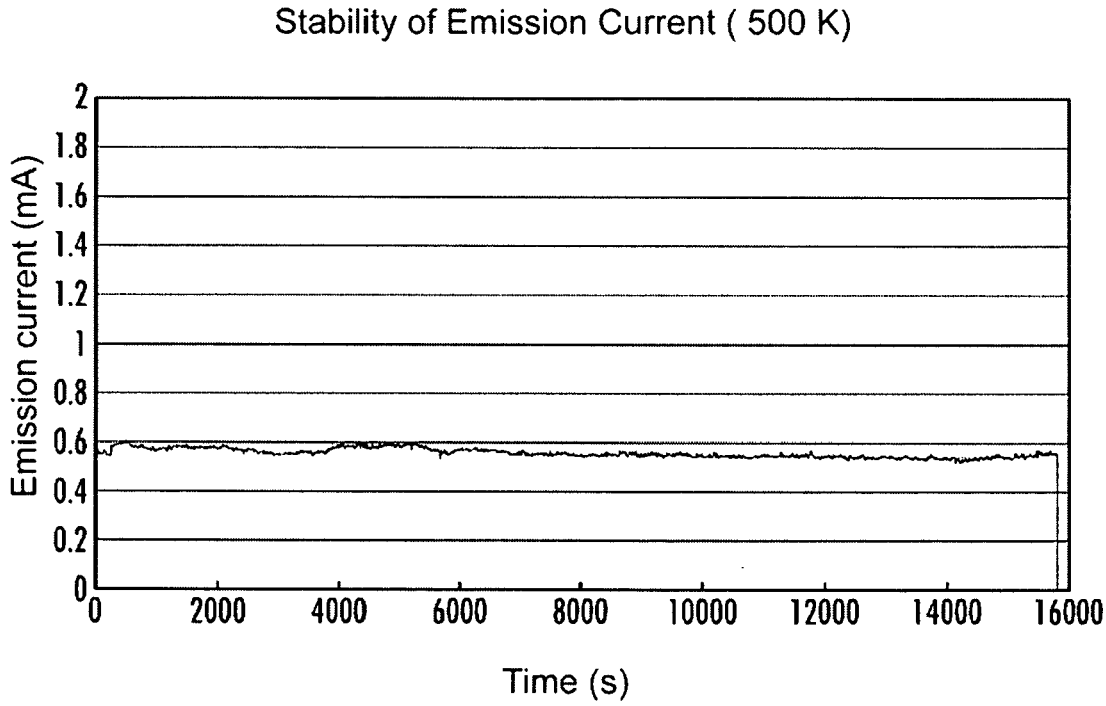
FIG. 4 is a graph showing the fluctuation of the emission current of a field emission electron source according to an embodiment of the present invention.

In the following, preferred embodiments of the present invention will be explained in detail with reference to attached figures. FIG. 1 is a schematic view of a field emission electron source according to an embodiment of the present invention. FIG. 2 is a graph showing the dependency of the emission current of a field emission electron source upon the applied electric field according to an embodiment of the present invention. FIGS. 3 and 4 are graphs showing the fluctuations of the emission current for an embodiment of the present invention.

FIG. 1 shows a field emission electron source 1 according to an embodiment of the present invention, where a vapor deposited film 3 made of molecules of aromatic compounds, e.g., molecules of pentacene 3*a*, is formed at the pointed end of a cold cathode 2 which is made of tungsten. The field emission electron source is installed in a chamber which is not illustrated.

The field emission electron source 1 can be manufactured by the following process. First, the cold cathode 2 is formed by polishing the surface of a cathode material of tungsten which has crystal planes of (100), (110), and (111) (See, e.g., Non-Patent Document 1). That polishing can be performed by applying DC voltage of several volts between the cathode material, which is set to be positively biased, and an oppositely facing negative electrode while immersing the cathode material in a mixture of an ammonium hydroxide solution and a potassium hydroxide solution, or in a potassium hydroxide solution.

Next, a clean surface at the pointed end of the cold cathode 2 is formed by applying the flushing treatment on the cold cathode 2 in ultra high vacuum. Then pentacene molecules 3*a* are vapor-deposited on the pointed end of the cold cathode 2 to form a vapor-deposited film 3. (See, e.g., Non-Patent Document 2). The vapor deposition of the pentacene molecule 3*a* can be performed by placing the pointed end of the cold cathode 2 close to a vapor-deposition boat having pentacene thereon or to a heater coated by pentacene in the vacuum, or by exposing the pointed end of the cold cathode 2 to the vapor of pentacene in the vacuum.

According to the field emission electron source 1 of an embodiment of the present invention, a large number of electrons are emitted from the vapor deposit film 3 that is vapor-deposited on the pointed end of the cold cathode 3 when a voltage is applied between the cold cathode 2 and a positive electrode (not illustrated), which is placed with a specified distance from the cold cathode 2. As a result, a large emission current can be obtained even when the applied voltage is small.

Here, pentacene, which forms the vapor deposit film 3, is one type of aromatic compound. The molecule of the aromatic compound forms a flat structure due to the fact that atoms of conjugate unsaturated ring make the $sp^2$ bonding with other neighboring atoms, and the molecule carries $\pi$ electron clouds caused by non-localized $\pi$ electrons on both sides of the flat structured molecule. Accordingly, the molecule of the aromatic compound 3*a* having this flat structure is considered to be vapor deposited such that it stands upright with respect to the pointed end of the cold cathode 2 of the field emission electron source 1. As a result, when the electric field is applied, it is considered that the electric field is concentrated at the end point of the flat structured pentacene molecule 3*a*, and the aforementioned $\pi$ electrons are extracted by the concentrated electric field, thereby yielding a large emission current.

Next, a working example of the present invention and a reference sample are described.

EXAMPLE

First, a cathode material that is made of tungsten having a crystal plane (011) was prepared. The cathode material was 5 mm long and 0.1 mm in diameter. Next, a cold cathode 2 was formed by the electro-chemical polishing in which DC voltage of 2-3 volts was applied between the cathode material, which was set to be positively biased, and an oppositely facing round-shape negative electrode while immersing the cathode material in a 25 wt. % ammonium hydroxide solution.

Next, a clean surface of the cold cathode 2 was prepared by performing the flushing treatment on the cold cathode 2 using electrical heating under ultra high vacuum of $10^{-8}$ Pa. Then a vapor of pentacene at a pressure of $10^{-6}$ Pa was introduced to the vacuum of $10^{-8}$ Pa and the pointed end of the cold cathode 2 was exposed to the pentacene vapor for a few seconds to form a vapor-deposited film 3 of pentacene molecules 3*a* on the pointed end of the cold cathode 3, thereby completing the field emission electron source 1 of the present example.

An electric field was applied to the emission electron source 1 of the present example by applying a voltage between the cold cathode 2 and a positive electrode (not illustrated), which is located 4 mm away from the cold cathode 2, at a temperature of 300K in the vacuum at $10^{-6}$ Pa. Then the emission current of the field emission electron source 1 was measured. FIG. 2 shows the measurement results.

Furthermore, fluctuation of the emission current of the field emission electron source 1 of the present example was measured while keeping the voltage between the cold cathode 2 and the not-illustrated positive electrode at 10 kV at a temperature of 300K. FIG. 3 shows the measurement result of the emission current as a function of time.

Next, fluctuation of the emission current of the field emission electron source 1 of the present example was measured while keeping the voltage between the cold cathode 2 and the not-illustrated positive electrode at 10 kV at a temperature at 500K and in the vacuum at $10^{-6}$ Pa. FIG. 4 shows the measurement result of the emission current as a function of time.

Reference Sample

First, a cold cathode made of tungsten was formed in the same way as in the aforementioned example and was used as an emission electron source for a reference sample. Thus, the pointed end of the cold cathode of the field emission electron source of the reference sample did not have the vapor deposition of the molecule of the aromatic compound.

Next, an electric field was applied to the emission electron source of the reference sample, by applying a voltage between the cold cathode and a positive electrode (not illustrated), which is located 4 mm away from the cold cathode at a temperature of 300K in the vacuum at 10⁻6 Pa. Then the emission current of the field emission electron source of the reference sample was measured. The measurement results are included in FIG. 2.

FIG. 2 clearly shows that when the applied voltage is 2000 V, the emission current of the field emission electron source of the reference sample is about $7\times10^{-10}$ A, whereas the emission current of the field emission electron source of the present example is about $1\times10^{-6}$ A, which is larger by a factor of about $10^3$ than that of the reference sample. Also, it can be seen that in order to obtain the emission current of $1\times10^{-7}$ A, the field emission electron source of the reference sample needs an applied voltage of about 8000 V, whereas the field emission electron source of the present example only needs an applied voltage of about 2000V, which is about one-fourth of that which is required for the reference sample. Therefore, in the example of the present invention, a large emission current can be obtained even when the applied voltage is small.

FIG. 3 shows that the emission current of the field emission electron source of the example at a temperature of 300K is in the range of 0.4 and 0.98 mA, indicating a rather large fluctuation of the emission current. It can also be seen that there exists two kinds of noises in the emission current: one is a noise that the emission current suddenly jumps up (spike-like noise), and another is a noise that the emission current is close to be constant increasing consistently in a certain period of time (step-like noise). On the other hand, as shown in FIG. 4, the emission current of the field emission electron source 1 of the present example at a temperature of 500K is in the range of 0.5 and 0.6 mA, indicating a smaller fluctuation than that at 300K. Also it can be seen that almost no spike-like noises or step-like noises occurs at 500K.

The aforementioned spike-like noise and the step-like noise are called "step/spike-like noise" and are a characteristic current fluctuation phenomenon for field emission electron sources that have a carbon-based material vapor deposited on the pointed end of the cold cathode. The cause of the above-mentioned fluctuation phenomenon of the emission current that occurred at 300K (FIG. 3) is considered to be due to the fact that the work function $\phi$ of the field emission electron source 1 drops because of the adsorption of molecules 3*a* in the residual gas in the chamber into the field emission electron source 1. Therefore, in order to reduce the chance of adsorption of the molecules 3*a* of the residual gas into the field emission electron source 1, the temperature is raised to about 500 K at which the pentacene molecules 3*a* of the vapor deposited film 3 do not evaporate. As a result, the emission current fluctuation can be suppressed, as shown in FIG. 4.

Accordingly, in the field emission electron source 1 of the present example, it becomes possible to obtain a stable emission current for a long time by raising the temperature to a certain temperature at which the pentacene molecules 3*a* of the vapor deposited film 3 do not evaporate.

In the present example, tungsten is used to form the cold cathode 2, but titanium, tantalum, and lanthanum hexaboride etc can also be used. As for the aromatic compound, instead of pentacene, one of the following compounds can also be used: benzene, phthalocyanine, flavanthrone, tris-(8-hydroxyquinoline) aluminum, coronene, oligothiophene, anthracene, perylene, ethylene, acetylene, polyacetylene, pyrene, benzoquinone, anthraquinone, aminopyrrolidine, halopyridine, pyrazine, indole, quinoline, stilbene, tetra-phenyl naphthacene, diphenyl anthracene, and tetra-phenyl benzene. Moreover, the suitable aromatic compound can include at least one of these compounds.

It will be apparent to those skilled in the art that various modification and variations can be made in the print management method and apparatus of the present invention without departing from the spirit or scope of the invention. Thus, it is intended that the present invention cover modifications and variations that come within the scope of the appended claims and their equivalents.

What is claimed is:

1. A field emission electron source for emitting electrons under applied electric field, comprising:

a cold cathode having molecules of an aromatic compound vapor-deposited thereon at a pointed end of said cold cathode, wherein said cold cathode is made of one of tungsten, titanium, tantalum, and lanthanum hexaboride.

2. The field emission electron source according to claim 1, wherein said aromatic compound is one of benzene, phthalocyanine, flavanthrone, tris-(8-hydroxyquinoline) aluminum, coronene, and pentacene.

3. The field emission electron source according to claim 1, wherein said aromatic compound includes at least one of pentacene, benzene, phthalocyanine, flavanthrone, tris-(8-hydroxyquinoline) aluminum, coronene, oligothiophene, anthracene, perylene, ethylene, acetylene, polyacetylene, pyrene, benzoquinone, anthraquinone, aminopyrrolidine, halopyridine, pyrazine, indole, quinoline, stilbene, tetra-phenyl naphthacene, diphenyl anthracene, and tetra-phenyl benzene.

4. The field emission electron source according to claim 1, wherein each molecule of the aromatic compound has a flat structure and is disposed on the pointed end of said cold cathode such that it stands substantially upright relative to a pointing direction of the pointed end.

5. The field emission electron source for emitting electrons under applied electric field, wherein a tip of said cold cathode is made of one of tungsten, titanium, tantalum, and lanthanum hexaboride.

* * * * *